United States Patent [19]

Cosar

[11] Patent Number: 4,809,620

[45] Date of Patent: Mar. 7, 1989

[54] APPARATUS FOR THE COMBUSTION OF POORLY COMBUSTIBLE FUELS

[75] Inventor: Paul Cosar, Paris, France

[73] Assignee: Fives-Cail Babcock, La Courneuve Cedex, France

[21] Appl. No.: 658,222

[22] Filed: Oct. 5, 1984

[30] Foreign Application Priority Data

Oct. 13, 1983 [FR] France ..... 83 16290

[51] Int. Cl.[4] ..... F23D 1/00

[52] U.S. Cl. ..... 110/263; 110/245; 110/255

[58] Field of Search ..... 110/245, 251, 255, 257, 110/258, 259, 263, 266, 118, 165 R, 167, 244

[56] References Cited

U.S. PATENT DOCUMENTS

| | | | |
|---|---|---|---|
| 2,483,728 | 10/1949 | Glaeser | 110/244 |
| 3,924,548 | 12/1975 | DuChambon | 110/244 X |
| 3,955,512 | 5/1976 | Martin et al. | 110/244 X |
| 4,270,468 | 6/1981 | Robinson et al. | 110/245 |
| 4,273,073 | 6/1981 | Robinson | 110/245 |
| 4,335,662 | 6/1982 | Jones | 110/245 X |

FOREIGN PATENT DOCUMENTS

| | | | |
|---|---|---|---|
| 2528543 | 12/1983 | France . | |
| 82611 | 5/1982 | Japan | 110/245 |
| 1448196 | 9/1976 | United Kingdom | 110/245 |

*Primary Examiner*—Steven E. Warner
*Attorney, Agent, or Firm*—Kurt Kelman

[57] ABSTRACT

An apparatus for the combustion of a poorly combustible fuel in a fluidized bed comprises a vertical front wall through which the poorly combustible fuel is delivered in particulate form and two lateral walls extending rearwardly from the front wall. A fixed grate extends from a front input end towards a rear discharge end between the lateral walls, and the two sides and the front input end of the grate define spaces with the lateral walls and the front wall, respectively. The fixed grate is upwardly inclined over at least a portion of its length from the input end to the discharge end whereby the discharge end is disposed above the input end, and the particulate fuel is delivered to the input end for forming a fluidized bed on the grate. A series of windboxes disposed under the grate along the length thereof blast combustion gas through the grate for fluidizing and burning the fuel while generating ashes moving rearwardly along the fluidized bed to the discharge end, and the discharge end constitutes a weir over which the ashes flow for easy removal. Plane surfaces are arranged in the spaces for supporting heaps of the particulate fuel.

8 Claims, 3 Drawing Sheets

APPARATUS FOR THE COMBUSTION OF POORLY COMBUSTIBLE FUELS

The present invention relates to an apparatus for the combustion of a poorly combustible fuel, such as carboniferous or bituminous shales, in a fluidized bed.

As is known, such fuels have a high content of ash and, in addition, when they are burned in a fluidized bed, the temperature of the bed is relatively low and insufficient to cause the formation of agglomerates of ash.

In French patent application No. 2,528,543 filed June 15, 1982, it has been proposed to utilize a fluidized bed hearth on a mobile grate for burning such fuels, which is known under the trade name "Ignifluid", of Fives-Cail Babcock, of Paris, France. The essential concept of this apparatus resides in the easy removal of the slag or ashes produced during the combustion of the carbon with agglomeration of the ashes. When the carbons are poorly combustible, such a solution appears to be relatively complex.

It is accordingly the primary object of this invention to propose a simpler and, therefore, more economical solution to this problem.

The above and other objects are accomplished according to the invention with an apparatus for the combustion of a poorly combustible fuel in a fluidized bed, which comprises a substantially vertical front wall, means for delivering the poorly combustible fuel in particulate form through the front wall, two lateral walls extending rearwardly from the front wall, and a fixed grate having two sides and extending from a front input end towards a rear discharge end between the lateral walls. The two sides and the front input end of the grate define spaces with the lateral walls and the front wall, respectively, the fixed grate is upwardly inclined over at least a portion of its length from the input end to the discharge end whereby the discharge end is disposed above the input end, and the delivering means feeds the particulate fuel to the input end for forming a fluidized bed on the grate. A series of windboxes is disposed under the grate along the length thereof, blasts of combustion gas from the windboxes fluidizing and burning the fuel while generating ashes moving rearwardly along the fluidized bed to the discharge end, and the discharge end constituting a weir over which the ashes flow, and plane surfaces are arranged in these spaces for supporting heaps of the particulate fuel.

Figure 1:
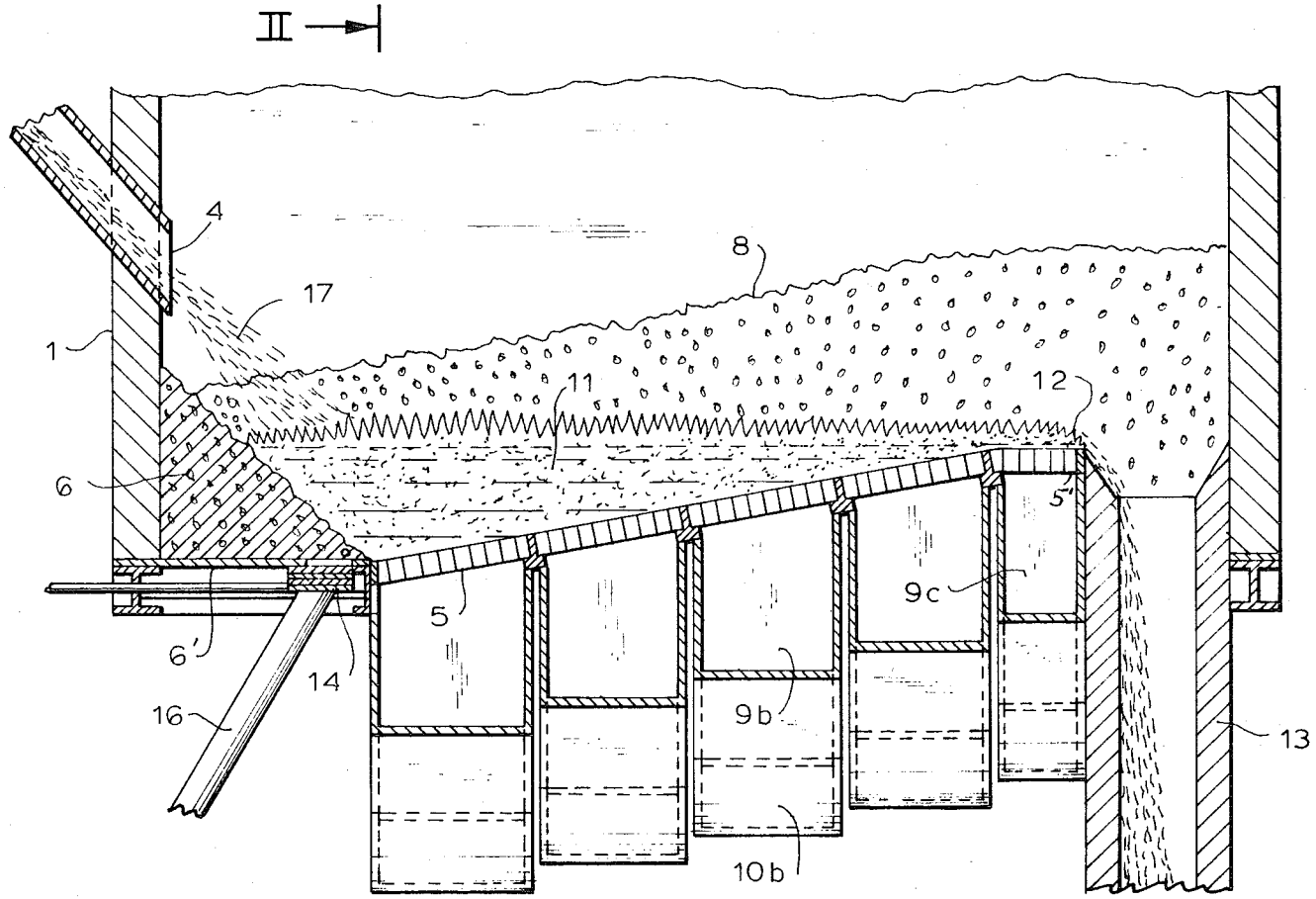
Figure 2:
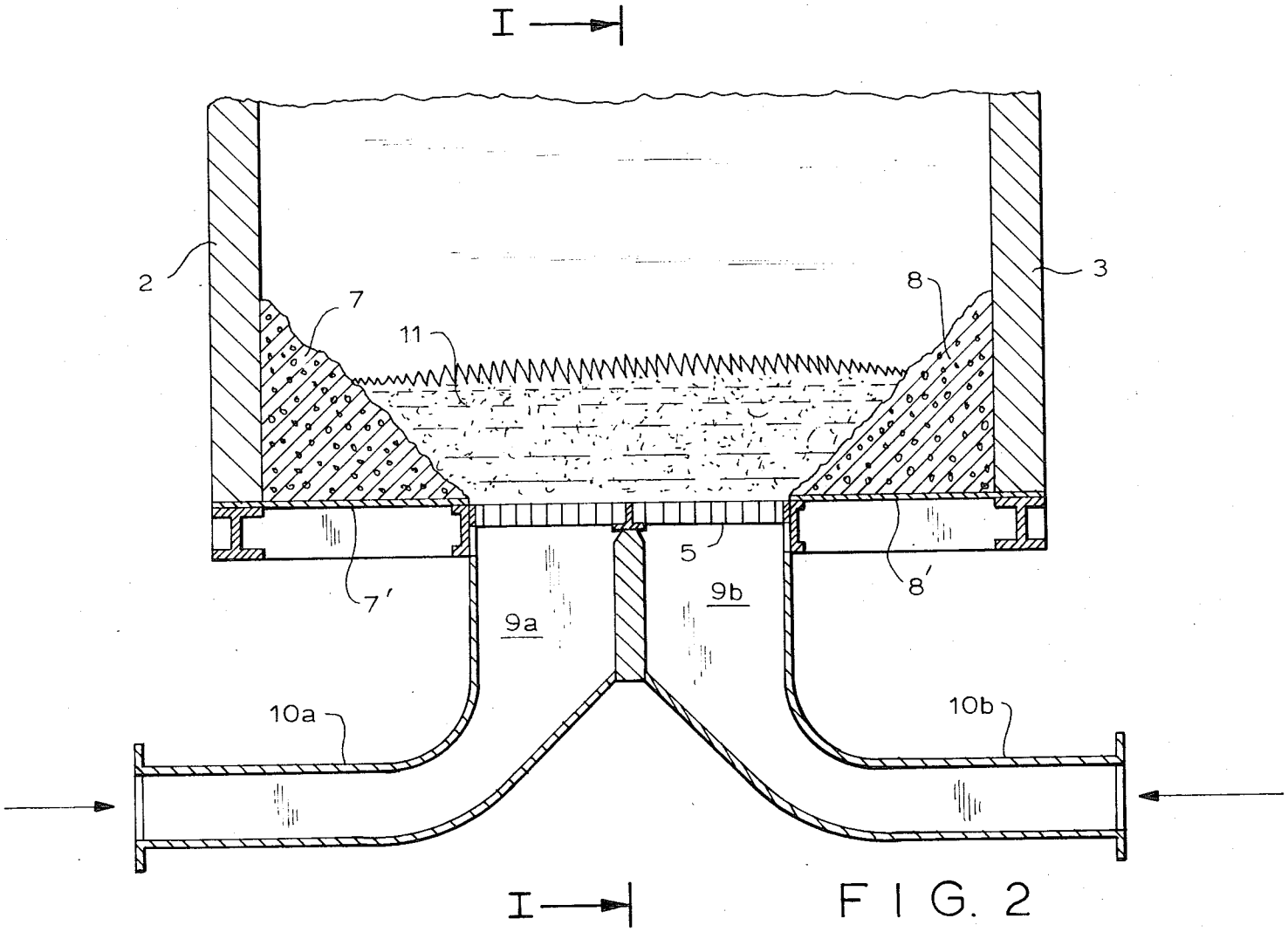
Figure 3:
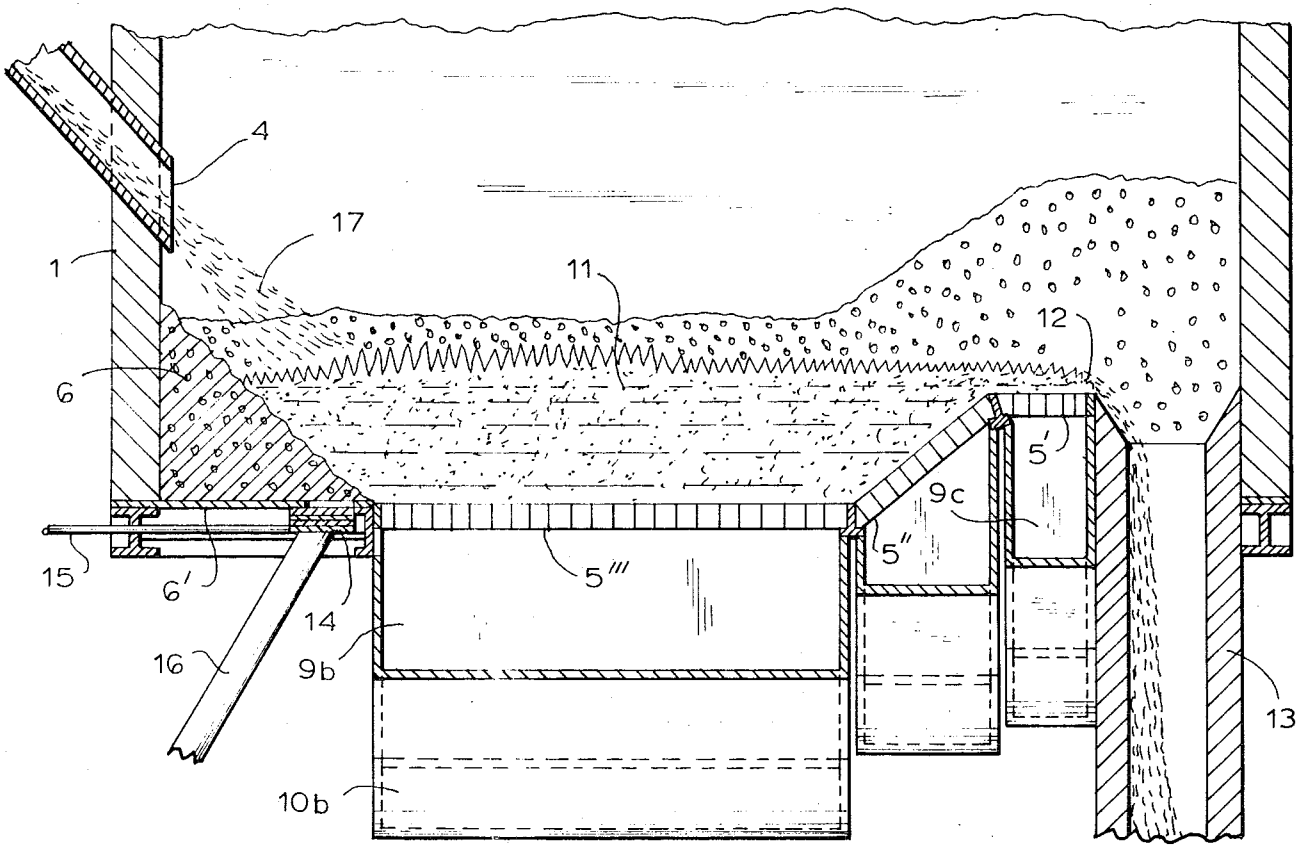

The above and other objects, advantages and features of the present invention will become more apparent from the following detailed description of certain now preferred embodiments thereof, taken in conjunction with the accompanying, somewhat schematic drawing wherein FIG. 1 shows a fragmentary longitudinal section of one embodiment of the combustion apparatus along line I—I of FIG. 2;

FIG. 2 is a transverse section along line II—II of FIG. 1 at the point of maximum depth of the fluidized bed; and FIG. 3 is a longitudinal section similar to that of FIG. 1, illustrating another embodiment of the combustion apparatus.

Referring now to the drawing and first to FIGS. 1 and 2, the illustrated apparatus for the combustion of a poorly combustible fuel in a fluidized bed comprises substantially vertical front wall 1, channel or chute 4 constituting means for delivering poorly combustible fuel 17, such as coal or shale, in particulate form through front wall 1, and two lateral walls 2 and 3 extending rearwardly from the front wall. Fixed grate 5 forms the bottom of a hearth chamber defined by the walls. The grate has two sides and extends from a front input end towards a rear discharge end between lateral walls 2 and 3. The two sides and the front input end of grate 5 define spaces with the lateral walls and front wall 1, respectively, and the fixed grate is upwardly inclined over its length from the input end to the discharge end whereby the discharge end is disposed above the input end. Particulate fuel delivering means 4 feeds particulate fuel 17 to the input end for forming fluidized bed 11 on grate 5. In this embodiment, grate 5 ascends in a substantially rectilinear line towards the discharge end.

A series of windboxes is disposed under grate 5 along the length thereof, blasts of a combustion gas, such as air, from the windboxes fluidizing and burning the fuel while generating ashes moving rearwardly along fluidized bed 11 to the discharge end. In the illustrated embodiment and as shown in FIG. 2, the windboxes are arrayed in a series of juxtaposed pairs of windboxes *9a*, *9b* disposed along the entire length of grate 5, each windbox *9a*, *9b* extending over half the width of the grate between the two sides thereof. Oppositely extending ducts *10a*, *10b* are connected to the windboxes to supply the combustion gas thereto. It will be understood, however, that each pair of windboxes *9a*, *9b* may be replaced by a single windbox fed by a single duct or by two ducts from opposite sides. The discharge end of grate 5 constitutes weir 12 over which the ashes flow, as shown in FIG. 1.

Plane surfaces 6', 7' and 8' are arranged in the spaces between the front wall and the input end as well as between the sides of the grates and the lateral walls for supporting heaps 6, 7 and 8 of the particulate fuel against the respective walls. These heaps of fuel form banks wherebetween fluidized bed 11 of the particulate fuel is held on grate 5, the fluidized bed being formed by the combustion gas blasts from the windboxes through the grate.

At the same rate as the fuel is fed through channel 4 to fluidized bed 11, particulate carbon material flows over weir 12 at the upper discharge end of grate 5 into conduit 13 through which the material is removed from the combustion apparatus. In effect, this overflowing carbon material is constituted essentially by ashes generated while the fuel moves rearwardly along fluidized bed 11 to the discharge end.

Preferably and as shown in FIGS. 1 and 3, the discharge end of the grate comprises short horizontal section 5' at the level of weir 12 to form an overflow ledge or ridge for the ashes.

Windboxes *9c* below short horizontal section 5' and close to the upper discharge end of grate 5 are arranged to provide a minimum blast to fluidize the ashes whereby they are maintained in motion to flow towards the discharge end.

Normally, no agglomeration of ashes will occur in this apparatus during the combustion of poorly combustible fuels. However, if some agglomerates should accidentally be formed, they would settle at the deepest portion of fluidized bed 11 at the base of fuel heap at the input end of grate 5. To remove any such agglomerates, the apparatus is equipped with means for removing the agglomerates, the illustrated means comprising horizontal sliding register 14 cooperating with a port in plane surface 6' defined between front wall 1 and the input end of grate 5. The position of the sliding register is controlled by rod 15 (FIG. 3) operable from outside the apparatus. The sliding register normally closes the port in plane surface 6'. It may be slid open by rod 15 for very brief periods of time to cause a portion of fuel heap 6 to flow through the port and take along the agglomerates at the adjacent bottom of the fluidized bed to remove the same through duct 16 connected to the port in plane surface 6'.

In FIG. 3, the same reference numerals as used in FIGS. 1 and 2 designate like parts operating in an equivalent manner to obviate redundancy in the description. This embodiment differs from the first-described embodiment in that the grate has a first horizontal portion 5''' adjacent the input end and succeeding portion 5'' upwardly inclined towards the discharge end, short horizontal section 5' being disposed at the discharge end in the same manner as described in connection with FIG. 1. Furthermore, only a single pair of windboxes is disposed below the horizontal portion, the inclined portion and the short horizontal section of the grate, respectively. This reduces the number of windboxes (each pair of windboxes being replaceable by a single windbox, if desired) and provides a larger volume of fluidized bed per surface area.

It is preferred to use a grate having a permeability descreasing from the input end towards the discharge end to adapt the grate to the concentration of carbon in fluidized bed 11, which varies in the same manner as the burning of the fuel proceeds.

While the invention has been described in connection with two now preferred embodiments, it will be clearly understood that changes and variations may occur to those skilled in the art, particularly after benefitting from the present teaching, without departing from the spirit and scope of this invention, as defined by the appended claims. Any one of the described and illustrated structures may be replaced by equivalent means.

What is claimed is:

1. An apparatus for the combustion of a poorly combustible fuel in a fluidized bed, which comprises (a) a substantially vertical front wall, (b) means for delivering the poorly combustible fuel in particulate form through the front wall, (c) two lateral walls extending rearwardly from the front wall, (d) a fixed grate having two sides and extending from a front input end towards a rear discharge end between the lateral walls, (1) the two sides and the front input end of the grate defining spaces with the lateral walls and the front wall, respectively, (2) the fixed grate being upwardly inclined over at least a portion of its length from the input end to the discharge end whereby the discharge end is displaced above the input end, and (3) the delivering means feeding the particulate fuel to the input end for forming a fluidized bed on the grate, (e) a series of windboxes disposed under the grate along the length thereof, blasts of combustion gas from the windboxes fluidizing and burning the fuel while generating ashes moving rearwardly along the fluidized bed to the discharge end whereby the fluidized bed consists of the fuel and the ashes, and the discharge end constituting a weir over which the ashes flow, and (f) plane surfaces arranged in said spaces for supporting heaps of the particulate fuel.

2. The combustion apparatus of claim 1, wherein one of the windboxes under the grate close to the upper discharge end is arranged to fluidize the ashes whereby they are maintained in motion to flow towards the discharge end.

3. The combustion apparatus of claim 1, wherein the grate has a permeability decreasing from the input end towards the discharge end.

4. The combustion apparatus of claim 1, further comprising means for removing any ash agglomerates formed during the combustion of the fuel.

5. The combustion apparatus of claim 4, wherein the means for removing ash agglomerates comprises a horizontal sliding register cooperating with a port in the plane surface defined between the front wall and the input end of the grate.

6. The combustion apparatus of claim 1, wherein the grate has a first horizontal portion adjacent the input end and a succeeding portion upwardly inclined towards the discharge end.

7. The combustion apparatus of claim 6, wherein a respective one of the windboxes is disposed below the horizontal portion and the inclined portion of the grate.

8. An apparatus for the combustion of a poorly combustible fuel in a fluidized bed, which comprises (a) a substantially vertical front wall, (b) means for delivering the poorly combustible fuel in particulate form through the front wall.

(c) two lateral walls extending rearwardly from the front wall, (d) a fixed grate having two sides and extending from a front input end towards a rear discharge end between the lateral walls, (1) the two sides and the front input end of the grate defining spaces with the lateral walls and the front wall, respectively, (2) the fixed grate being upwardly inclined over at least a portion of its length from the input end to the discharge end whereby the discharge end is disposed above the input end, and (3) the delivering means feeding the particulate fuel to the input end for forming a fluidized bed on the grate, (e) a series of windboxes disposed under the grate along the length thereof, blasts of combustion gas from the windboxes fluidizing and burning the fuel while generating ashes moving rearwardly along the fluidized bed to the discharge end whereby the fluidized bed consists of the fuel and the ashes, and the discharge end constituting a weir over which the ashes flow and comprising a short horizontal section at the level of the wear to form an overflow ridge for the ashes, and (f) plane surfaces arranged in said spaces for supporting heaps of the particulate fuel.

* * * * *